US005173563A

United States Patent [19]

Gray

[11] Patent Number: 5,173,563

[45] Date of Patent: Dec. 22, 1992

[54] BENCH REST FOR RIFLE SIGHTING

[76] Inventor: Johnny H. Gray, Rte. 1 Box 51, Keatchie, La. 71046

[21] Appl. No.: 854,740

[22] Filed: Mar. 23, 1992

[51] Int. Cl.[5] ..... F41C 29/00

[52] U.S. Cl. ..... 42/94

[58] Field of Search ..... 42/94; 89/37.04, 40.06, 89/41.19

[56] References Cited

U.S. PATENT DOCUMENTS

| | | | |
|---|---|---|---|
| 3,282,164 | 11/1966 | Vickers | 89/40.06 |
| 3,703,046 | 11/1972 | Barone et al. | 42/94 |
| 4,026,057 | 5/1977 | Cady | 42/94 |
| 4,296,963 | 10/1981 | Blanchard et al. | 297/170 |
| 4,409,751 | 10/1983 | Goda et al. | 42/94 |
| 4,506,466 | 3/1985 | Hall | 42/94 |
| 4,535,559 | 8/1985 | Hall | 42/94 |
| 4,937,965 | 7/1990 | Narvaez | 42/94 |
| 5,060,410 | 10/1991 | Mueller | 42/94 |
| 5,070,636 | 12/1991 | Mueller | 42/94 |
| 5,081,783 | 1/1992 | Jarvis | 42/94 |

*Primary Examiner*—David H. Brown

*Attorney, Agent, or Firm*—John M. Harrison

[57] ABSTRACT

A bench rest for supporting both a rifle and a rifleman for accurately "sighting in" the rifle on a target. In a preferred embodiment the bench rest includes a frame constructed of plastic pipe such as polyvinylchloride pipe and fittings, having a seat for supporting the rifleman, a fixed cradle for receiving the stock of the rifle and an adjustable cradle for receiving the forestock or barrel of the rifle and mounting the rifle in secure, yet vertically and horizontally adjustable relationship. In a most preferred embodiment of the invention the adjustable cradle is moved vertically and horizontally by crank operation of threaded rods during the "sighting in" process.

10 Claims, 2 Drawing Sheets

FIG. 4
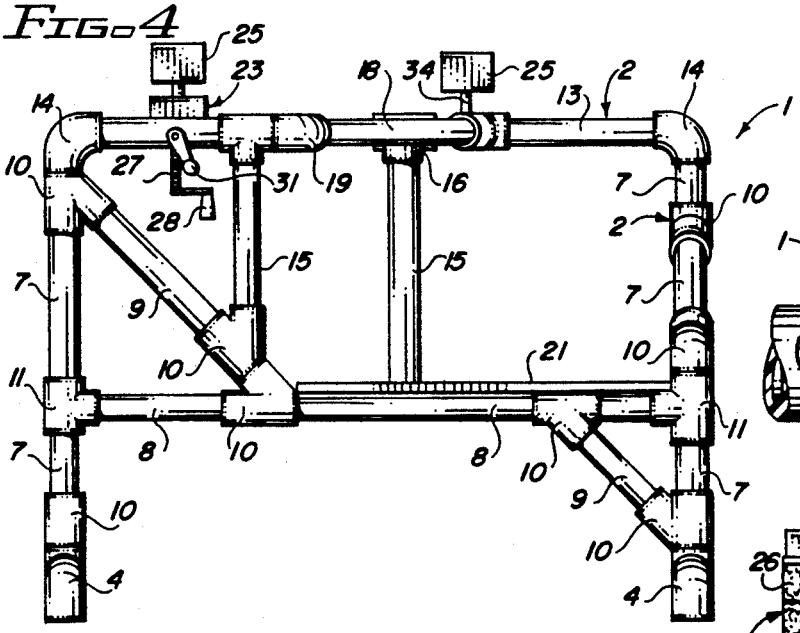
FIG. 6
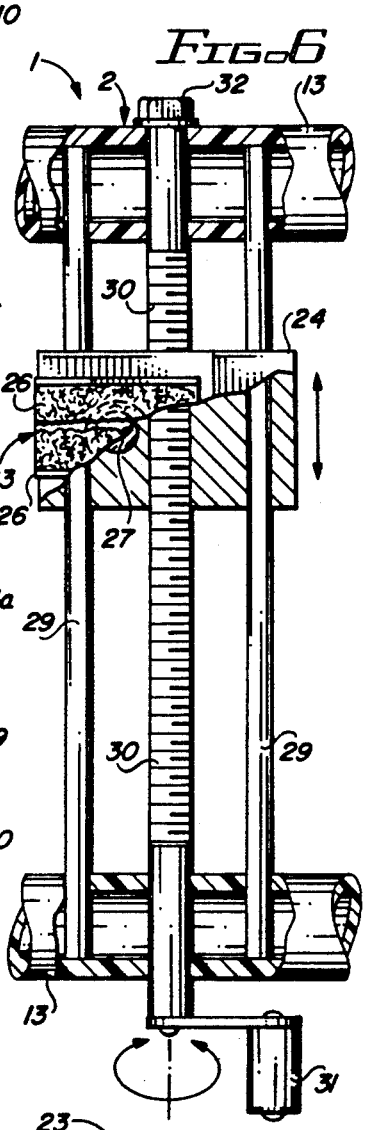
FIG. 5
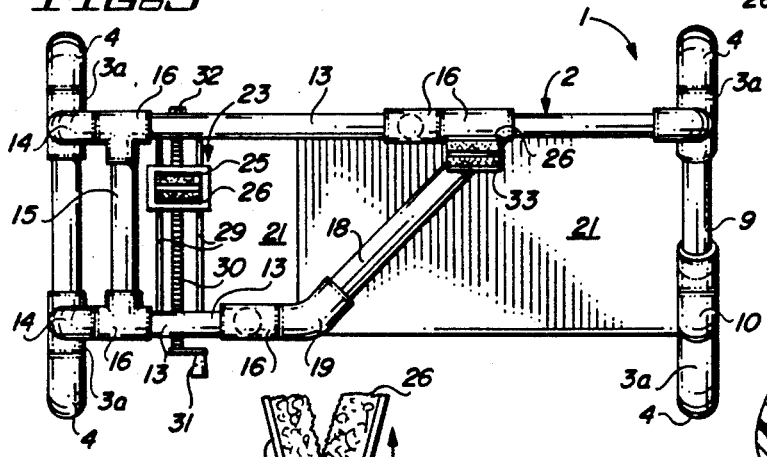
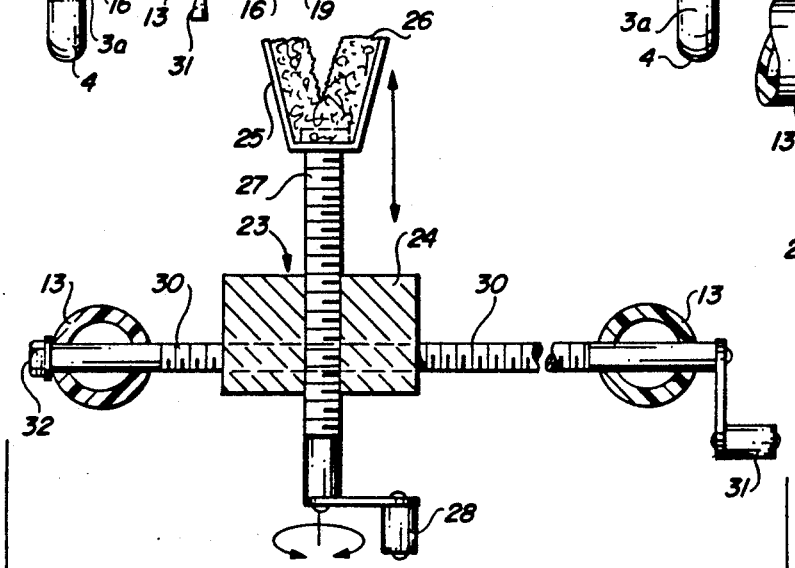
FIG. 7
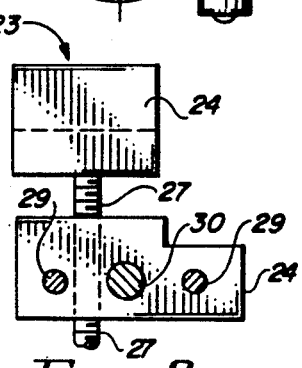
FIG. 8

BENCH REST FOR RIFLE SIGHTING

BACKGROUND OF THE INVENTION

1. Field of the Invention

This invention relates to apparatus for "sighting in" rifles and more particularly, to a bench rest for accommodating a rifleman, immobilizing a rifle and "sighting in" the rifle in a highly efficient manner. In a preferred embodiment the bench rest is constructed of plastic pipe such as polyvinylchloride piping using various polyvinylchloride pipe fittings, a seat or platform is provided to support the rifleman and both fixed and adjustable cradles are sued to securely, yet adjustably, mount the rifle. In a most preferred embodiment the adjustable cradle is fitted with vertical and horizontally-oriented, threaded rods adjusted by crank or rod handles to facilitate positioning of the sights or rifle scope directly on the target. The polyvinylchloride (PVC) bench rest is light in weight, yet highly rigid and sturdy for the intended purpose.

2. Description of the Prior Art

One of the problems which is inherent in testing and sighting rifles for accuracy or in target shooting is that of immobilizing the rifle to a desired extent in order to adjust the iron sights or rifle scope to extreme accuracy at selected distances. This objective is typically accomplished by placing the rifle on a table, bench or other support and using sand bags to prop the rifle in a secure position and enable the shooter or rifleman to accurately focus the sights on the target and make the necessary adjustments to the sights or scope. Typical of devices which may be utilized of this purpose is the "Instrument-Supporting Tripod with Seat" detailed in U.S. Pat. No. 2,982,338, dated May 2, 1961, to W. Arthur Ernst. While the device is designed to support an electric generator for military usage and provides a seat for the operator of the hand cranked instrument, it might also be used to support a rifle for "sighting in" or target shooting purposes. U.S. Pat. No. 4,055,017, dated Oct. 25, 1977, to Harold Thompson, details a "Mini Bench Rest". The bench rest includes a mounting base adapted to permit articulation for both pitch and yaw and a bench having a beam mounted to a collar and fitted with a front support rest. The front support rest is adjustable for elevation with respect to the main plane of the beam and the beam also includes a detachably mounted rear support for long barrel guns such as rifles. A "Firearm Shooting Support Table" is detailed in U.S. Pat. No. 4,296,963, dated Oct. 27, 1981, to Kenneth G. Blanchard, et al. The shooting table includes a table portion for supporting a firearm and a seat portion for supporting the operator or rifleman while firing the firearm with the firearm resting on the table portion. The table has a pair of front legs to support the front of the table and the seat portion includes a pair of horizontally-extending support members extending from the seat and pivotally mounted to the front legs of the table to pivotally support the seat portion of the front of the table. The horizontally-extending support members telescope to adjust the seat toward or away from the table. The seat portion also has a pair of legs mounted to the seat portion of the rear of the table to support the rear end of the seat separate from the table and the table has a support leg at its rearward end to support the rearward end of the table. U.S. Pat. No. 4,501,082, dated Feb. 26, 1985, to F. Joseph Phillips, et al, details a "Portable Bench Rest". The bench rest includes an upper cross member having legs pivotally attached thereto to allow for collapsing of the legs for carrying the shooting bench and a brace secures one of the legs in an extended position during use of the bench. The other leg carries a rest member at its upper end, which rest member is adjustable for elevation by pivoting the leg about its pivotable attachment to the upper cross member. U.S. Pat. No. 4,506,466, dated Mar. 26, 1985, to Stanley J. Hall, details a "Portable Shooter's Bench". The bench includes top, front and rear leg assemblies pivotally connected thereto, which leg assemblies fold inwardly to provide a pocket for carrying a seat which is movably connected to the leg assemblies when they are folded outwardly at the point of use. The bench top is inclined and is vertically and angularly adjustable and also has a lateral recess which overlies the seat for accommodating the upper body of the shooter when seated on the seat. An adjustable gun rest is provided at the front of the bench top for supporting the forearm of the shooter's gun. U.S. Pat. No. 4,535,559, dated Aug. 20, 1985, to Michael F. Hall, details a "Portable Shooting Bench" which apparatus enables more accurate firing of rifles and other firearms and is particularly adapted for use for this purpose in hard-to-reach locations and/or over extended periods of use because of its lightness of weight and compactness when assembled for portage. A "Portable Blind" is detailed in U.S. Pat. No .4,788,997, dated Dec. 6, 1988, to L. M. Clopton. The lightweight, portable blind includes a quick adjustable combination armrest/shooting rail, roof and roof support members, all of which attach to a folding outdoor chair, using clamps. A camouflage slip cover encloses the entire blind to conceal the person inside.

It is an object of this invention to provide a new and improved bench rest for "sighting in" rifles, which bench rest includes a rigid frame having a platform or seat for supporting a rifleman and a pair of cradles for receiving the stock and forestock, or barrel, respectively, of a rifle to stabilize the rifle and facilitate adjusting the rifle sights or scope to impact a bullet on a target.

Another object of this invention is to provide a bench rest for receiving both a rifle and rifleman in a stabilized configuration and facilitate sighting in the rifle sights or scope on a target.

Yet another object of this invention is to provide a new and improved bench rest for "sighting in" rifles and patterning shotguns, which bench rest includes a rigid frame fitted with a fixed cradle for receiving and immobilizing the rifle or shotgun stock and an adjustable cradle for receiving the rifle or shotgun forestock or barrel and further provided with a seat or platform for supporting a rifleman to facilitate "sighting in" the rifle on a target or determining the shot pattern of a shotgun at various distances.

A still further object of this invention is to provide a plastic piping bench rest for supporting a rifle and rifleman in rigid, stable configuration, which bench rest includes a fixed cradle for receiving the stock of the rifle and an adjustable cradle for receiving the forestock or barrel of the rifle, which adjustable cradle is supported on a block and threaded rod apparatus which may be adjusted in both the horizontal and vertical directions to "sight in" the rifle.

SUMMARY OF THE INVENTION

These and other objects of the invention are provided in a new and improved bench rest for sighting in rifles, which bench rest includes a rigid, light frame constructed of polyvinylchloride pipe and suitable polyvinylchloride pipe fittings and includes a seat, a fixed cradle for receiving the stock of the rifle and an adjustable cradle for receiving the forestock of the rifle. The adjustable cradle is further provided with a support block that threadably receives horizontally and vertically oriented threaded rod and rod handles or cranks for adjusting the adjustable cradle and rifle barrel in the horizontal and vertical directions and sighting the rifle in on a target.

BRIEF DESCRIPTION OF THE DRAWINGS

The invention will be better understood by reference to the accompanying drawings, wherein:

FIG. 4 is a left side view of the bench rest illustrated in FIG. 1;

FIG. 5 is a top view of the bench rest illustrated in FIG. 1;

FIG. 6 is a sectional view taken along line 6—6 in FIG. 1, of a preferred adjustable cradle assembly for vertically and horizontally adjusting the rifle barrel when the rifle is in the shooting position illustrated in FIG. 1;

FIG. 7 is a sectional view taken along line 7—7 in FIG. 1 of the adjustable cradle assembly illustrated in FIG. 6; and FIG. 8 is a side view, partially in section, of the adjustable cradle illustrated in FIGS. 6 and 7.

DESCRIPTION OF THE PREFERRED EMBODIMENTS

Figure 1:
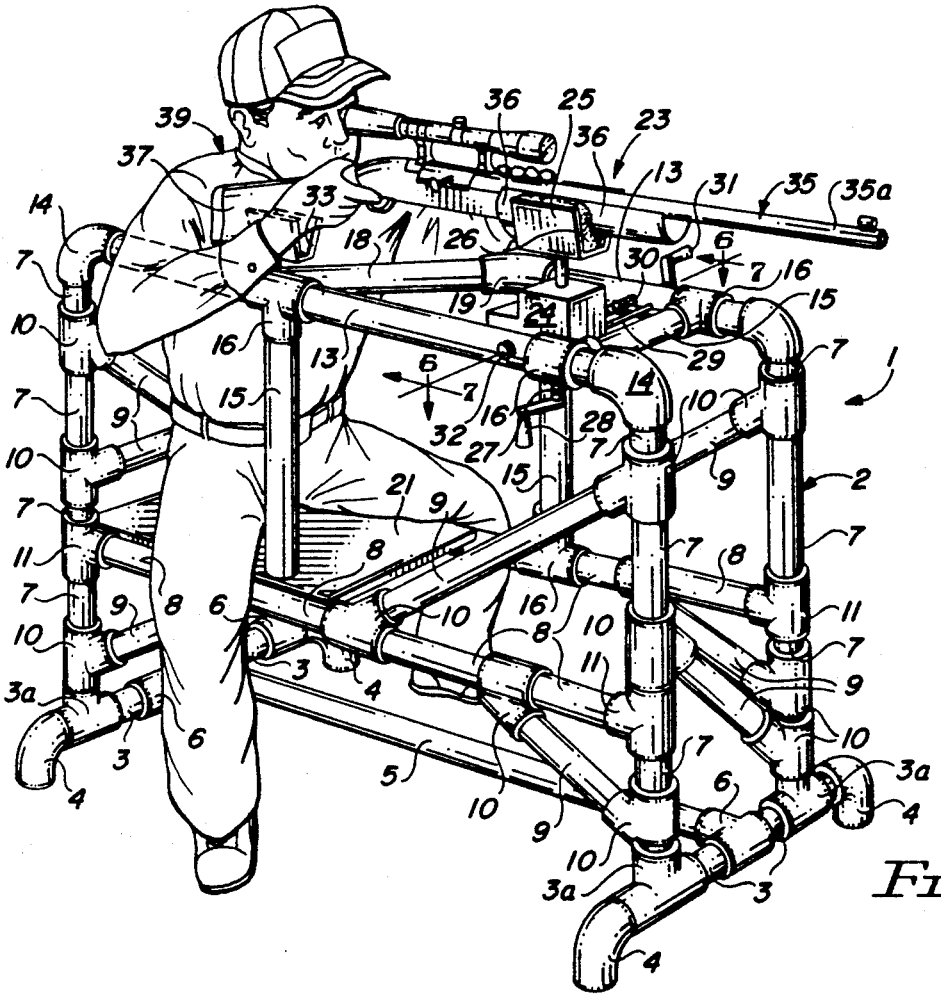
FIG. 1 is a perspective view of a preferred embodiment of the bench rest of this invention, with a rifleman and a rifle in functional shooting position.
Figure 2:
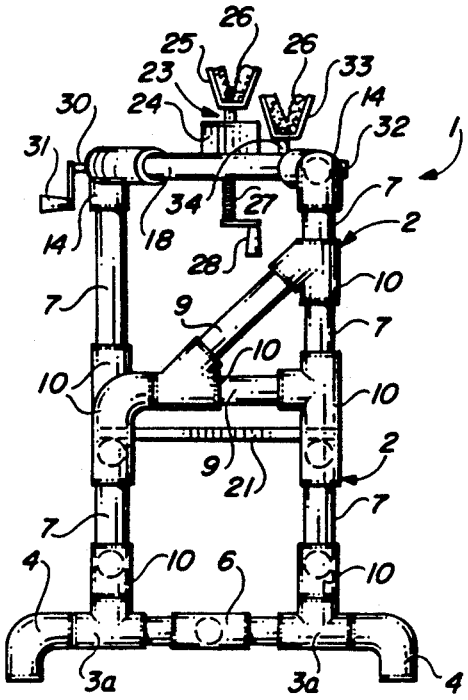
FIG. 2 is a rear view of the bench rest illustrated in FIG. 1.
Figure 3:
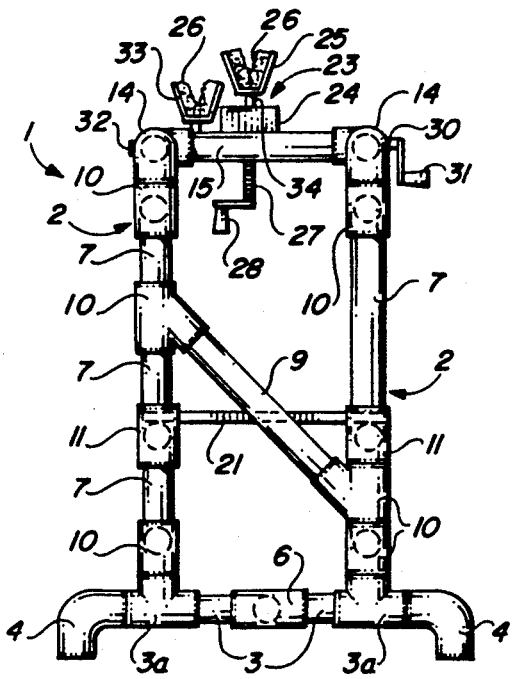
FIG. 3 is a front view of the bench rest illustrated in FIG. 1.

Referring initially to FIGS. 1–5 of the drawings, in a preferred embodiment the bench rest for rifle sighting of this invention is generally illustrated by reference numeral 1. In a most preferred embodiment of the invention the bench rest frame 2 of the bench rest 1 is characterized by conventional assembled and glued polyvinyl chloride (PVC) piping and fittings, including regular and angular tee fittings and elbow fittings, in non-exclusive particular. Typically, a set of support bars 3 and provided on each end of the bench rest frame 2 and each set of support bars 3 is connected by support bar couplers 3*a* and a brace coupler 6, and receives a bar foot 4 on each end. Each support bar coupler 3*a* and brace coupler 6 is characterized by a tee fitting, while each bar foot 4 is characterized by an elbow fitting, both constructed by PVC material. A bar brace 5 projects between each set of support bars 3 and projects into the tee leg of the brace coupler 6 on each of the sets of support bars 3, as illustrated. Spaced, parallel, vertical leg members 7 extend upwardly from the tee legs of the support bar couplers 3*a*, respectively, and are provided with leg brace couplers 10, characterized by offset PVC tee fittings, which leg brace couplers 10 also receive leg braces 9, projecting into the tee legs of corresponding leg brace couplers 10, installed on spaced, parallel, horizontal side members 8, respectively. The side members 8 are attached to the respective leg members 7 by side member couplers 11, which are characterized by PVC teel fittings. An additional leg brace 9 projects between the respective leg members 7 at the seat end of the bench rest frame 2 and is secured in position by additional tee fitting leg brace couplers 10, to further stabilize the bench rest 1. Accordingly, it will be appreciated from a consideration of FIG. 1 of the drawings that one set of leg braces 9 project upwardly from corresponding leg brace couplers 10 attached to the respective vertical leg members 7, while another set of leg braces 9 project downwardly from the upper end of the leg members 7 to the horizontal side members 8, where they are secured by additional leg brace couplers 10. A pair of top member couplers 14, which are characterized by PVC elbow fittings, secure the tops of the respective vertical leg members 7 to corresponding ends of the spaced, parallel, horizontal top members 13 and the top members 13 are vertically spaced from the parallel side members 8 by top member braces 15, secured in position by corresponding top member brace couplers 16, also characterized by PVC tee fittings. A horizontal angle member 18 is secured to one of the top members 13 by an angle member coupler 19, which is characterized by a PVC 45 degree elbow fitting and is secured to the opposite top member 13 by means of a 45 degree PVC top member brace coupler 16, as illustrated in FIG. 5. A platform or seat 21 rests on the parallel side members 8 at one end of the bench rest frame 2 and is secured in position by fasteners such as screws or bolts (not illustrated). Accordingly, it will be appreciated from a consideration of FIG. 1 that a rifleman 39 may straddle the seat 21 with one leg projecting over one of the side members 8 and the opposite leg projecting over the opposite side member 8 and his right arm resting on one of the top member 13, to grasp a rifle 35 in firing configuration. The stock 37 of the rifle 35 is cradled in a V-shaped fixed cradle 33, secured to the angle member 18 by means of a cradle bolt 34, and the forestock 36 in a V-shaped adjustable cradle 25 element of an adjustable support mechanism 23.

Referring now to FIGS. 1, 5 and 6–8 of the drawings, in a most preferred embodiment of the invention a support block 24 element of the adjustable support mechanism 23 is suspended horizontally between the top members 13 of the bench rest frame 2 on a pair of spaced cradle guide rods 29, which span a horizontal threaded rod 30, threaded through the support block 24 and fitted with horizontal rod crank 31. The horizontal threaded rod 30 is secured in position on the top members 13 by means of a rod bolt 32, which is threaded into a drilled and tapped receptacle (not illustrated) in one end of the horizontal threaded rod 30, as illustrated in FIGS. 1, 5, 6 and 7. Accordingly, the support block 24 is caused to move horizontally on the cradle guide rods 29 along the horizontal threaded rod 30 responsive to rotation of the horizontal rod cranks 31 to adjust the "yaw", or horizontal swing of the adjustable cradle 25 and rifle barrel 35*a*. Furthermore, as illustrated in FIGS. 1, 7 and 8 of the drawings the adjustable cradle 25 is vertically mounted above the support block 24 one end of a vertical threaded rod 27, threaded through the support block 24 and fitted with a vertical rod crank 28 mounted on the bottom end thereof. Accordingly, rotation of the vertical rod crank 28 adjusts the adjustable cradle 25 vertically to further adjust the "pitch" or vertical orientation of the rifle barrel 35*a*. In another preferred embodiment of the invention the forestock 36 of the rifle 35 rests in a cradle pad 26, fitted in the adjustable cradle 25, to securely, yet removably, immobilize the forestock 36 and yet prevent scratching of the finish on the forestock 36. Similarly, the stock 37 of the rifle 35 is designed to seat in a similar cradle pad 26 located in the fixed cradle 33, designed for the same purpose. The cradle pads 26 may typically be constructed of foam rubber of similar material, which serve to immobilize the stock 37 and forestock 36.

It will be appreciated from a consideration of FIGS. 1 and 6–8 of the drawings that the rifle 35 is pivotally mounted in the adjustable cradle 25 of the adjustable support mechanism 23 when the stock 37 is lifted from the fixed cradle 33, since the vertical threaded rod 27 is threadably mounted in the support block 24. Accordingly, the bench rest 1 can be utilized to fire the rifle at several horizontally-disposed targets by swinging the stock 37 of the rifle 35 in an arc after lifting the stock 37 from the fixed cradle 33. It will be further appreciated by those skilled in the art that the adjustable support mechanism 23 may be fixed and designed such that the adjustable cradle 25 is fixed between the top members 13 in the same manner as the fixed cradle 33, under circumstances where it is not desired to adjust the height and lateral movement of the rifle barrel 35*a*. Accordingly, under these circumstances, the bench rest 1 may be set up to face a target at a selected distance from the rifle 35, the rifle barrel 35*a* seated in a fixed version of the adjustable cradle 25 and the stock 37 then seated in the fixed cradle 33, to effect the desired rifle sighting. However, in a most preferred embodiment of the invention the adjustable support mechanism 23 is utilized to facilitate selective vertical and horizontal adjustment of the adjustable cradle 25 and therefore the rifle barrel 35*a*, to provide additional latitude in sighting of the rifle by the rifleman 39.

It will be further appreciated by those skilled in the art that in addition to serving as a support for rifle sighting, the bench rest can also be used to pattern shotguns. Furthermore, while the forestock of the rifle or shotgun is preferably placed in the adjustable cradle, the barrel can also be so positioned moreover, the bench rest 1 can be constructed of any desired material, including wool, metal, plastic, fiberglass or the like, according to the knowledge of those skilled in the art. However, in a most preferred embodiment, PVC plastic is preferred because of the rigidity, high strength-to-weight ratio and ease of assembly and adjustment of the respective structural members to accommodate a rifleman or shooter of desired size and weight. For example, under circumstances where the rifleman or shooter is extremely large, the distance between the top member braces 15 and leg members 7 might be extended during the construction of the bench rest 1 to better and more comfortably accommodate the rifleman or shooter. Under circumstances where the bench rest 1 is constructed of PVC material, the respective structural members can be assembled using a suitable PVC cement which is well known to those skilled in the art. Furthermore, due to the nature of the PVC material, the various structural components can be easily cut and shaped to fit in a desired configuration to effectuate the intents and purpose of the invention.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularly set forth above, what is claimed is:

1. A bench rest for sighting in a rifle on a target, comprising frame means for accommodating a rifleman, rear cradle means carried by said frame means in fixed relationship for stabilizing the stock of the rifle and a horizontal threaded rod carried by said frame means in substantially horizontally relationship; a first rod crank carried by said horizontal threaded rod for rotating said horizontal threaded rod; a support block threaded on said horizontal threaded rod; a vertical threaded rod threadably carried by said support block; a second rod crank carried by said vertical threaded rod for rotating said vertical threaded rod; and an adjustable cradle carried by said vertical threaded rod for receiving the forestock of the rifle whereby said support block and said adjustable cradle are horizontally adjusted responsive to manipulation of said first rod crank, and said support block and said adjustable cradle are vertically adjustable responsive to manipulation of said second rad crank wherein the rifle may be adjusted and immobilized to accurately impact a bullet on the target.

2. The bench rest of claim 1 further comprising a seat provided in said frame means for supporting the rifleman and a pair of guide rods carried by said frame means in horizontal, spaced, parallel relationship and extending through said support block for stabilizing said support block and said adjustable cradle in horizontally slidably relationship.

3. The bench rest of claim 1 wherein said frame means further comprises a frame constructed of polyvinylchloride pipe and polyvinylchloride pipe fittings connecting said polyvinylchloride pipe.

4. The bench rest of claim 3 further comprising a seat provided in said frame said rear cradle means for securing the stock of the rifle in said rear cradle means and an adjustable cradle pad provided in said adjustable cradle for securing the forestock of the rifle in said adjustable cradle.

5. A bench rest for stabilizing a firearm during target practice, comprising a substantially rigid frame having a platform for accommodating a shooter; a fixed cradle carried by said frame in fixed relationship for stabilizing the stock of the firearm; and a horizontal threaded rod carried by said frame in substantially horizontal relationship; a first rod crank carried by said horizontal threaded rod for rotating said horizontal threaded rod; a support block threaded on said horizontal threaded rod; a vertical threaded rod threadably carried by said support block; a second rod crank carried by said vertical threaded rod for rotating said vertical threaded rod; and an adjustable cradle carried by said vertical threaded rod for receiving the barrel of the firearm, whereby said support block and said adjustable cradle are horizontally adjusted responsive to manipulation of said first rod crank and said support block and said adjustable cradle are vertically adjustable responsive to manipulation of said second rod crank, the stock of the forearm is substantially immobilized in said fixed cradle and the barrel of the firearm is selectively horizontally and vertically adjustable in said adjustable cradle by the shooter by aiming the firearm at the target.

6. The bench rest of claim 5 further comprising a pair of guide rods carried by said frame in horizontal, spaced relationship and extending through said support block on opposite sides of said threaded rod for stabilizing said support block in slidable relationship on said horizontal threaded rod.

7. The bench rest of claim 6 further comprising a fixed cradle pad provided in said fixed cradle for removably securing the stock of the firearm, in said fixed cradle and an adjustable cradle pad provided in said adjustable cradle for removably securing the barrel of the firearm in said adjustable cradle.

8. The bench rest of claim 7 wherein said frame means further comprises a frame constructed of polyvinylchloride pipe and polyvinylchloride pipe fittings connecting said polyvinylchloride pipe.

9. A bench rest for immobilizing and adjusting a rifle during target practice, comprising a substantially rigid frame having a platform for supporting a rifleman; a fixed cradle carried by said frame in fixed relationship for receiving and supporting the stock of the rifle and an adjustable rifle support characterized by a horizontal threaded rod carried by said frame in substantially horizontal relationship; a first rod crank carried by said horizontal threaded rod for rotating said horizontal threaded rod; a support block threaded on said horizontal threaded rod; a pair of guide rods carried by said frame in horizontal, spaced relationship and extending through said support block on opposite sides of said horizontal threaded rod for stabilizing said support block in slidably relationship on said horizontal threaded rod; a vertical threaded rod threadably carried by said support block; a second rod crank carried by said vertical threaded rod for rotating said vertical threaded rod; and an adjustable cradle carried by said vertical threaded rod for receiving the forestock of the rifle, whereby said support block and said adjustable cradle are horizontally adjusted responsive to manipulation of said first rod crank and said support block and said adjustable cradle are vertically adjustable responsive to manipulation of said second rod crank.

10. The bench rest of claim 9 wherein said frame is constructed of polyvinylchloride pipe and polyvinylchloride pipe fittings connecting said polyvinylchloride pipe and further comprising a fixed cradle pad provided in said fixed cradle for removably securing the stock of said rifle in said fixed cradle and an adjustable cradle pad provided in said adjustable cradle for removably securing the forestock of said rifle in said adjustable cradle.

* * * * *